US010626773B2

(12) United States Patent
Gehrlein et al.

(10) Patent No.: US 10,626,773 B2
(45) Date of Patent: Apr. 21, 2020

(54) MIX BOX

(71) Applicant: TENNECO GMBH, Edenkoben (DE)

(72) Inventors: Joachim Gehrlein, Rheinzabern (DE); Frank Terres, Frankeneck (DE); Andreas Lang, Hassloch (DE); Gert Müller, Mannheim (DE)

(73) Assignee: TENNECO GMBH, Edenkoben (DE)

( * ) Notice: Subject to any disclaimer, the term of this patent is extended or adjusted under 35 U.S.C. 154(b) by 254 days.

(21) Appl. No.: 15/552,416

(22) PCT Filed: Mar. 4, 2016

(86) PCT No.: PCT/EP2016/054662
§ 371 (c)(1),
(2) Date: Aug. 21, 2017

(87) PCT Pub. No.: WO2016/142292
PCT Pub. Date: Sep. 15, 2016

(65) Prior Publication Data

US 2018/0030874 A1 Feb. 1, 2018

(30) Foreign Application Priority Data

Mar. 6, 2015 (DE) ..... 10 2015 103 303

(51) Int. Cl.
*F01N 3/28* (2006.01)
*F01N 13/18* (2010.01)
(Continued)

(52) U.S. Cl.
CPC ..... *F01N 3/2892* (2013.01); *B01F 3/04049* (2013.01); *B01F 5/0057* (2013.01);
(Continued)

(58) Field of Classification Search
CPC .. B01F 3/04049; B01F 5/0057; B01F 5/0451; B01F 2005/0091; F01N 13/1888;
(Continued)

(56) References Cited

U.S. PATENT DOCUMENTS 6,722,124 B2 * 4/2004 Pawson ..... B01D 53/9431 60/286
9,410,464 B2 * 8/2016 Hicks ..... F01N 3/2066
(Continued)

FOREIGN PATENT DOCUMENTS

DE 20 2007 010 324 U1 1/2009
DE 20 2014 102 872 U1 8/2014
(Continued)

*Primary Examiner* — Matthew T Largi
(74) *Attorney, Agent, or Firm* — Hudak, Shunk & Farine Co. LPA

(57) ABSTRACT

A mix box for an exhaust system of an internal combustion engine, the mix box being used to incorporate additives into an exhaust gas flow and including at least one inlet tube, at least one outlet tube and a housing for accommodating the inlet tube and the outlet tube, wherein: the housing delimits a volume of the mix box in relation to the surroundings; the inlet tube has an inflow section located inside the housing, which inflow section is provided with at least one inflow opening for introducing the exhaust gas into the housing; the outlet tube has a metering device designed as an injection nozzle at the end of the outlet tube and has an outflow section located inside the housing, which outflow section has a length (La) and is provided with at least one outflow opening for discharging the exhaust gas from the housing; a flow zone is provided between the inlet tube and the outlet tube and the flow zone, over at least 30% of its length (La), is free of flow guiding elements which deflect the flow in a circumferential direction and which have an outer face and an inner face inside the volume.

21 Claims, 5 Drawing Sheets

(51) Int. Cl.

| | |
|---|---|
| ***B01F 3/04*** | (2006.01) |
| ***B01F 5/00*** | (2006.01) |
| ***B01F 5/04*** | (2006.01) |
| *F01N 3/20* | (2006.01) |

(52) U.S. Cl.
CPC ..... *B01F 5/0451* (2013.01); *F01N 13/1888* (2013.01); *B01F 2005/0091* (2013.01); *F01N 3/2066* (2013.01); *F01N 2240/20* (2013.01); *F01N 2470/04* (2013.01); *F01N 2470/18* (2013.01); *F01N 2470/20* (2013.01); *F01N 2490/00* (2013.01); *F01N 2490/18* (2013.01); *F01N 2610/02* (2013.01)

(58) Field of Classification Search
CPC ..... F01N 3/2892; F01N 2240/20; F01N 2470/04; F01N 2470/18; F01N 2470/20; F01N 2490/00; F01N 2490/18; F01N 2610/02; F01N 3/2066
See application file for complete search history.

(56) References Cited

U.S. PATENT DOCUMENTS

| | | | | |
|---|---|---|---|---|
| 9,435,240 | B2 * | 9/2016 | Sampath | F01N 3/206 |
| 2005/0279572 | A1 | 12/2005 | Birgersson | |
| 2009/0044522 | A1 | 2/2009 | Nakahira et al. | |
| 2009/0313979 | A1 * | 12/2009 | Kowada | B01D 53/9431 60/297 |
| 2010/0132348 | A1 * | 6/2010 | Kowada | B01D 53/9431 60/324 |
| 2010/0263359 | A1 * | 10/2010 | Haverkamp | F01N 3/2066 60/303 |
| 2011/0099978 | A1 * | 5/2011 | Davidson | F01N 3/2066 60/274 |
| 2011/0308234 | A1 * | 12/2011 | De Rudder | B01F 3/04049 60/295 |
| 2014/0202141 | A1 | 7/2014 | Quan et al. | |
| 2016/0312680 | A1 * | 10/2016 | Gehrlein | F01N 3/2892 |
| 2018/0163601 | A1 * | 6/2018 | Doring | F01N 3/2885 |

FOREIGN PATENT DOCUMENTS

| | | | |
|---|---|---|---|
| DE | 10 2013 114 111 | A1 | 6/2015 |
| EP | 1 262 644 | A2 | 12/2002 |
| EP | 2 025 890 | A1 | 2/2009 |
| EP | 2 119 885 | A1 | 11/2009 |
| EP | 2 128 398 | A1 | 12/2009 |
| EP | 2 168 672 | A1 | 3/2010 |
| EP | 2 687 697 | A2 | 1/2014 |
| JP | 2013136991 | A | 7/2013 |
| JP | 2014129819 | A | 7/2014 |
| WO | 2014/167355 | A1 | 10/2014 |
| WO | 2015091242 | A1 | 6/2015 |

* cited by examiner y-y y-y

MIX BOX

FIELD OF THE INVENTION

The invention relates to a device for mixing exhaust gases, i.e. a mix box for an exhaust system of an internal combustion engine for incorporating additives into an exhaust gas flow with at least one inlet tube featuring an E-tube axis, with at least one outlet tube featuring an A-tube axis and with a housing featuring a housing wall with an inner face and an outer face for holding the inlet tube and the outlet tube, wherein the housing delimits a volume V of the mix box in relation to the surroundings, wherein the inlet tube features on the end side a metering device, such as an injection nozzle, and an inflow section within the housing with a diameter Dz and a length Lz, which is equipped with at least one inflow opening for introducing the exhaust gas into the housing, wherein the outlet tube features on the end side an injection nozzle and an outflow section arranged within the housing with a diameter Da and a length La, which for the purpose of discharging the exhaust gas from the housing is equipped with at least one outflow opening, wherein a flow zone S is provided between the inlet tube and the outlet tube, which is delimited at the side by two boundary areas B1, B2, which respectively feature a shortest distance a12, a13, a22, a23 to the respective point on the respective tube axis.

BACKGROUND OF THE INVENTION

A mixer tube arrangement with a housing is already known from EP 2 687 697 A2. The arrangement features an inlet tube and a parallel outlet tube which are arranged in the housing. Within a spiral section of the housing wall, the outlet tube is positioned eccentrically, so that a tapering inlet gap is formed.

A mixer tube arrangement with a housing is also known from WO 2014/167355 A1. The arrangement features an outlet tube which is partially arranged in the housing.

A mixer tube arrangement with a housing is known from US 2014 0 202 141 A1, wherein the inlet tube and outlet tube are perforation-free and are aligned at right-angles to each other.

A mixer tube with housing is also already known from DE 10 2013 114 111 A1. The arrangement also features an inlet tube and a parallel outlet tube which are arranged in the housing.

SUMMARY OF THE INVENTION

The object of the invention is to design and arrange a mixer tube arrangement in such a manner that despite its simple structure, optimal incorporation is achieved.

The object of the invention is attained by means of the fact that over at least 30% to 90%, or at least 30% to 50%, or at least 70% to 90%, of the length La, at least one portion Sf of 70%, or 80%, or 90%, of the flow zone S is free of flow guiding elements, wherein a flow guiding element causes a deflection of the flow into a circumferential direction U or into a direction R radial to the A-tube axis and the flow guiding element features a wall side and a gas side which are both arranged within the volume V. The respective flow zone S between the inflow section and the outflow section lies in the section plane to be considered, which is usually at right-angles to the A-tube axis. The flow zone S ends above at the level of the E-tube axis and below at the level of the A-tube axis. At the side, the flow zone S ends on the two boundary areas B1, B2. The sum of all flow zones S of the different section planes spans a flow volume Vs as a portion of the housing volume.

Flow guiding elements are components within the volume V, which supplement the housing wall on the inner face and which have a not insignificant influence over the deflection of the exhaust gas flow in the circumferential direction U to the A-tube axis and/or in a direction R radial to the A-tube axis. Parts of the housing wall that limit the volume V of the mix box towards the outside should not be regarded as flow guiding elements in the sense of the invention. This also applies when these parts of the housing wall are arranged within the flow zone S. Flow guiding elements are characterized by the fact that both their wall or outer face which faces towards the next housing wall and their gas or inner face which faces towards the main gas flow are arranged within the housing in the volume V.

The largest possible flow volume should be provided within which the flow zones S are free of flow guiding elements. This is achieved through two conditions. On the one hand, the flow volume should extend over at least 30% to 50% of the length La, i.e. the highest possible number of flow zones S should be free of flow guiding elements, so that the exhaust gas can flow without a deflection in the radial direction R or in the circumferential direction U from the inlet tube into the outlet tube. If within this share of 30% to 50% of the length La a lesser portion Sb of the flow zones S is blocked by a flow guiding element, i.e. it is not free, this is not a disadvantage. On the other hand, however, this share should not reach Sb 30%, i.e. a share of Sf=70% should be free. As a result, it is necessary that in relation to the length La, the flow zones S must be free over at least 21% of the outflow section.

The outflow section is the portion of the outflow tube which features at least one outflow opening. Usually, several outflow openings are provided in the form of a series, which are distributed over the circumference U. If the outlet tube features an outlet flow which is considerably shorter than the portion of the outlet tube located in the housing, when assessing the share of the length La which is free of flow guiding elements, the sum of the lengths of the different rows of outflow openings should be taken into account which together form the length of the outflow section.

For this purpose, it can also be advantageous when the following applies for the respective distance a12, a13, a22, a23: $0<a12<=x1*Dz$ and $0<a13<=x2*Da$ and $0<a22<=x3*Dz$ and $0<a23<=x4*Da$, wherein the respective value x1, x2, x3, x4 is an element of the number group {2; 1.5; 1; ½; ¼}, wherein the respective distances a12, a13, a22, a23 can differ in size and/or vary over the respective length Lz, La.

The object of the invention is also attained through the fact that a) the outlet tube features a tube radius Ra=Da/2 and a radial distance r1, r2, r5, r6 to the inner face of the housing wall and/or to a flow guiding element, wherein a1) the distances r1, r2 are the same in relation to a respective axis A2 which is arranged at right-angles to the A-tube axis, or which deviate by a maximum of 10% or 20% or 30%, or a2) in relation to an angle range β of at least 90° to 270°, or of at least 160° to 200° around the A-tube axis a2i) the distance r6 to the next flow guiding element and/or the distance r5 to the next housing wall is the same or deviates by a maximum of 10% or 20% or 30% and/or a2ii) the ratio of the tube radius Ra to at least one of the distances r1 or r5 or r6 is a maximum of six or a maximum of three, or a) the inflow section and the outflow section limit a volume V23 and a differential volume V1=V−V23 or the volume V fulfils the following condition: V1>=1.2*V23, or V>=2.2*V23. The volume V1 is accordingly maximum 20% higher than the volume V23 as a sum of the volume of the inflow section and the outflow section. The volume V23 of the two tubes results from the sum of the volumes of both tubes. V23=π/4 (Lz*Dz*Dz+La*Da*Da). Through the use of a housing with a corresponding size, a homogenization of the exhaust gas flow is guaranteed, in particular while flowing into the outlet tube or the inflow section.

For the angle range β the flow path F can be selected as the starting point or as the angle bisector, so that within the corresponding sector, the above-named distances or ratios are provided.

Since the inflow openings and outflow openings can also be designed as flaps or moldings, which are directed inwards and/or outwards, the average diameter or the diameter of the original tube wall without flaps or moldings is taken into account when giving the diameter Dz, Da and with the radius Ra.

A minimum size for the flow zone S would be achieved when a portion of the housing wall is designed as a flow guiding element and/or when additional flow guiding elements are provided in the form of baffle plates, wherein a direct flow connection between the inlet tube and the outlet tube in relation to at least one flow path F in the direction of a flow vector T is provided, wherein the flow vector T connects the E-tube axis and the A-tube axis.

As a result of the above measures, an essentially direct inflow of the outlet tube which is axially or mirror symmetric is achieved and supported. The outlet tube sits symmetrically in the housing section that surrounds it vis-à-vis the inlet tube. In this way, a considerable portion of the exhaust gas flow can flow directly to the outlet tube, starting from the inlet tube or the inflow openings, without a deflection by flow guiding elements such as the housing wall or baffle plates. As a result, a predominantly non-spinning and non-eddying flow is formed within the housing, which is defined to a significant degree by the inflow openings. This exhaust gas flow can then enter into the outlet tube. The nature of the flow within the outlet tube is therefore determined to a significant degree by the geometry of the outflow section or outflow opening. This in turn guarantees an optimum incorporation of the additive.

The housing can advantageously feature a cuboid or cylindrical basic form with a cylinder radius Z, wherein at least 80% to 90% of the surface area portions of the housing wall are either flat or feature a curve radius K that corresponds to the cylinder radius Z. Such a simply designed housing forms the basis for the most non-influenced exhaust gas flow possible within the housing between the inlet tube and the outlet tube.

Additionally, it can be advantageous when the outflow section can be flowed around over 360° on its outer face. Here, a distance to the housing wall of at least Da/8 to Da/4 is provided. Therefore, the symmetry of the inflow into the outflow section of the outlet tube is guaranteed.

For the ratio of the tube sizes, it can be advantageous when the following applies for the diameter Da: 0.8*Dz<=Da<=1.5*Dz. This applies when a form of the tubes deviates from the cylinder, both for the profile being considered respectively, i.e. point by point, or alternatively a diameter Dz, Da which is averaged over the length Lz, La.

In general, it is possible to vary the diameter Dz, Da over the length Lz, La. However, this is not of relevance for the definition of the principle according to the invention, i.e. for the definition of the boundary areas B1, B2 and the distances a12, a22, a13, a23, r1, r2, r3, r4, r5. Depending on the profile or intersection point of the section plane used, the geometrical relations in the respective section plane are considered.

For this purpose, it can also be advantageous when a metering device such as an injection nozzle is provided, which is arranged coaxially to the outlet tube, wherein the injection nozzle features a spraying angle δ with 5°<=δ<=80° or 10°<=δ<=60°. This is the nominal size of the spraying angle δ, i.e. measured without the exhaust gas flow. The spraying angle δ is selected in such a way that an intersection point X with the tube wall lies within the mixing section S2 after the rinsing sector S1.

Further, it can be advantageous when the outlet tube penetrates the housing wall at two opposite positions. Thus, the arrangement of the metering device on the end side on the one hand and the discharge of the exhaust gas on the side opposite the metering device on the other hand are possible.

It can also be advantageous when the outlet tube features a blade which is hinged on at least one side in the area of one or more outflow openings, which protrude inwards or outwards in the radial direction. If the blade is designed as a flap, it features a straight bending edge. On the basis of a right-angled basic form, said blade can therefore feature three free sides, so that the exhaust gas can flow over the free edge and around the blade over at least 60% to 80% of its circumference, and enter into the outflow opening. Alternatively, blades can also be provided which feature a rounded connection to the tube wall, which is usually longer than a straight bending edge. The exhaust gas can in this case only flow over the free edge and around the blade via a smaller portion of its circumference and enter into the outflow opening.

Here, it can advantageously be provided that in the inlet tube, the degree of perforation decreases in the flow direction. Thus, the entering volume flow increases in the direction of the metering device, which leads to an improved incorporation.

For the present invention, it can be of particular importance when an interim wall is provided which is aligned parallel to a main flow direction H. The interim wall serves to stabilize the housing or to support the tubes. A disadvantageous influence over the exhaust gas flow within the housing does not therefore occur between the inlet tube and the outlet tube. Due to the intermediate wall, only those flow portions are eliminated with a direction component parallel to the E- or A-tube axis. This in turn contributes to the formation of a calmer flow between both tubes.

In connection with the design and arrangement according to the invention, it can be advantageous when the inlet tube features a truncated cone-shaped basic form G1 and/or the outlet tube features a truncated cone-shaped basic form G2, wherein the inlet tube and the outlet tube are aligned in the same direction or in the counter direction in relation to the basic form G1, G2. If the tubes are aligned in the same direction, the housing itself or the profile of the housing can also have a truncated cone shape.

It can further be advantageous when the housing is formed from a maximum of two or three housing sections and features at least one connecting flange for both housing sections. This guarantees a simple structure on the one hand, and favorable mounting conditions for the tubes on the other. Both housing sections can be produced form the same shell blank. With the exception of special structural forms such as a plug-in flange, each housing section usually has its own flange, so that both flanges are connected to each other for coupling the two housing sections.

For this purpose, it is also possible for the housing to feature a first housing section with a first housing edge and at least one second housing section with a second housing edge, wherein both housing sections are connected at least partially via the housing edge which spans a partition plane e, wherein the housing edge is point symmetric in relation to a measurement standard N of the partition plane e or axially symmetric in relation to a straight line G of the partition plane e. While the axially symmetric design of the housing edge or the flange permits a variation of the relative position of both housing sections in two positions pivoted around 180°, the point symmetric design guarantees at least a variation with at least four positions, i.e. in steps around 90°.

Further, it can be advantageous when the outlet tube features several rows of outflow openings arranged over a circumference U, through which the exhaust gas can flow into the interior of the outlet tube, wherein the at least one outflow opening of one row respectively forms a step M and wherein the respective step M is characterized according to its size by the average opening profile Q of the openings, wherein the sum of all opening profiles Q of all outflow openings of all rows of the outlet tube equals SQ, wherein at least one step of the first order, step M1, is provided, wherein step M1 features outflow openings with an average opening profile Q1, and when additionally at least one step of the second order, step M2, is provided, wherein step M2 features outflow openings with an average opening profile Q2 with Q2>=f*Q1, with 5<=f<=25, and when a first sector S1 is provided, which is designed as a rinsing sector, which is formed from at least the one step M1, and when a second sector S2 is provided which is formed as a mixing sector, and which is formed from at least the one step M2, wherein in the flow direction initially the first sector S1 and then the second sector S2 is positioned. Due to the arrangement of two sectors S1, S2 with different opening profiles, a rinsing effect of the sector S1 is achieved, through which return rinsing effects are prevented in the area of the dosing device or nozzle. Due to the smaller opening profile Q1, only a sheath flow is realized within the outlet tube. This in turn guarantees the incorporation of the additive into the main exhaust gas flow in sector 2, the opening profiles of which are considerably larger.

Here, it can be advantageous when the sector S1 features a sum SQ1 of the opening profiles Q1 with SQ1<=x1*SQ, with 0.05<=x1<=0.25 and/or when the sector S1 is formed from a maximum of three to five steps M1. In addition to the smaller opening profiles, the opening size is reduced overall, so that the rinsing effect is put better to use. Sector S1 is preferably blade-free.

Further, it can be advantageous when a spraying cone is provided with a spraying angle δ, wherein the spraying angle δ is selected in such a manner that an intersection point X is provided between the spraying cone and the outlet tube in the flow direction after the first sector S1 and/or within the second sector S2. In this way, the rinsing effect is supported. A deposition of additive in the nozzle area is prevented.

Finally, it can also be advantageous when the housing features a first housing section with a first housing edge and at least one second housing section with a second housing edge, wherein both housing sections are connected at least partially via the housing edge, and when the inlet tube features an inflow section arranged within the housing, which is equipped with at least one inflow opening for introducing the exhaust gas into the housing, wherein a) the respective housing edge features at least two moldings, each with a middle axis, and/or b) the respective housing section features at least two passages, each with a middle axis and the respective tube features bearing positions via which it is supported within the moldings or within the passages, wherein i) the respective tube is symmetrically formed with regard to the formation of the bearing positions and for the purpose of mounting can be supported in the respective molding in at least two different positions P1, P2, or ii) the inlet tube and the outlet tube are designed in the same way with regard to the formation of the bearing positions.

As a result, it is achieved that the relative position between the respective tube and the housing and/or the relative position of the tube within the housing can be varied. This variation can be achieved as follows:

i) Through a different alignment of the inlet tube or the outlet tube in relation to the same molding or the same passage. The inlet tube or the outlet tube can selectively be turned in order to change the direction of the inlet and the outlet of the tube, and with it the direction in which the exhaust gas is guided. This change of position can only be used for the inlet pipe or only for the outlet pipe.

ii) By replacing the position of the inlet tube with the position of the outlet tube. As a supplement to variant i), as a result of the replacement, additional design variants of the mixer or its gas guidance geometry can be achieved. Thus, the middle axes of two moldings each or of two passages can be overlapped with the E-tube axis and the A-tube axis, so that as an alternative, the inlet tube or the outlet tube can be supported in the housing shell or the housing section with regard to the respective position P1, P2.

iii) Through a change to the relative position of both housing sections or housing shells with respect to each other. In this case, with the use of passages in particular, the gas guidance geometry can be achieved independently of the flexible support of the tubes as described in variants i) and ii). The tubes arranged in the respective shell or in the housing floor or the resulting gas guidance geometry is varied due to the change in the relative position of both housing shells or housing walls to each other. For the relative positions P1, P2, not only a right angle is feasible, but also any angle required.

The molding of the respective housing edge guarantees that the respective tube will be held over a partial circumference of approx. 180° in each case, so that as a result of both opposite moldings and with a passage, a support and sealing of the respective tube is guaranteed over the circumference U.

BRIEF DESCRIPTION OF THE DRAWINGS

Further advantages and details of the invention are explained in the patent claims and in the description, and shown in the figures, in which:

DETAILED DESCRIPTION OF THE INVENTION

Figure 1:
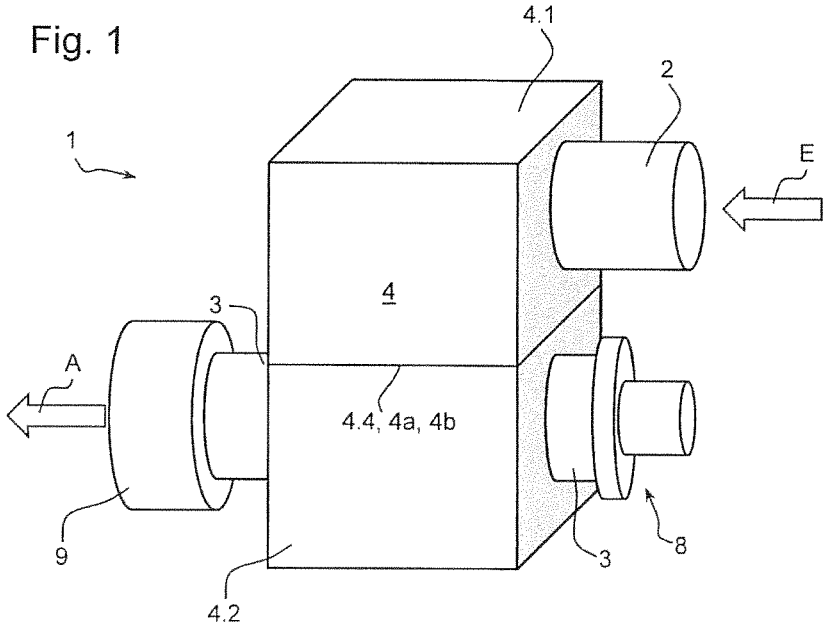
FIG. 1 shows a principle sketch of the mix box with a cuboid basic form.

A mix box 1 according to FIG. 1 is formed from two housing sections 4.1, 4.2 with one housing edge 4*a*, 4*b* each, which are coupled with each other via a connecting flange 4.4. Within the first housing section 4.1, an inlet tube 2 is arranged with an inlet E for exhaust gas, while in the second housing section 4.2, an outlet tube 3 is positioned with an outlet A. The respective housing section 4.1, 4.2 features corresponding passages, within which the tubes 2, 3 are supported. On the end side, the outlet tube 3 features an injection nozzle 8, through which an additive can be introduced into the outlet tube 3. On the outlet side, a swirl mixer 10 is preferably positioned on the outlet tube 3.

Figure 2:
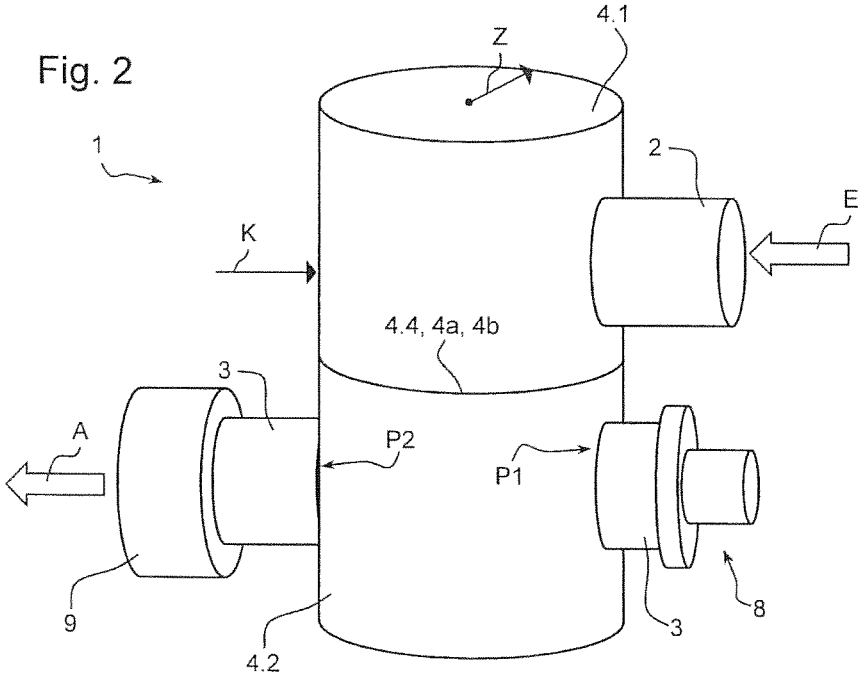
FIG. 2 shows a principle sketch of the mix box with a cylindrical basic form.

According to FIG. 2, the connecting flange 4.4 is rounded in orientation to the cylindrical basic form, while both housing sections 4.1, 4.2 feature a curve radius K which corresponds to the cylinder radius Z.

Figure 3:
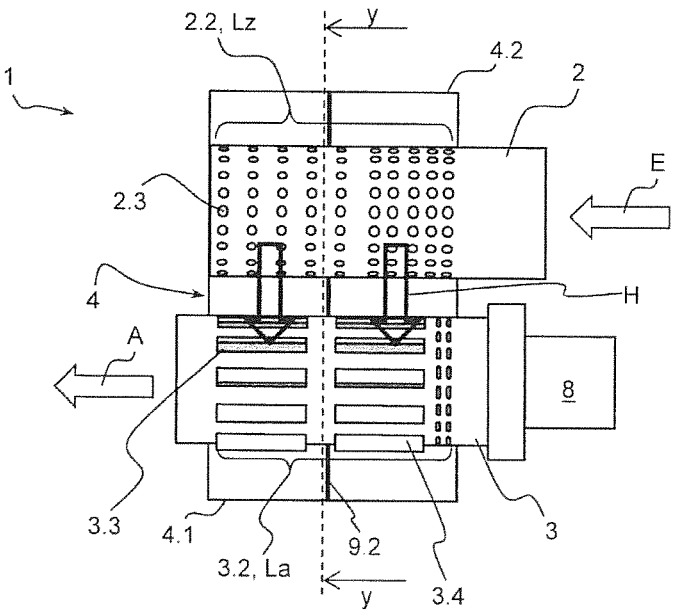
FIG. 3 shows the principle sketch of a profile view according to FIG. 1 or 2.

In the profile view in FIG. 3, it is shown that the inlet tube 2 features an inflow section 2.2 of length Lz, which is formed from several rows of inflow openings 2.3. Starting from the inlet E of the mix box 1 and the axial inflow, the exhaust gas is deflected over the inflow openings 2.3 in the radial direction and flows from the inlet tube 2 following a main flow direction H to the outlet tube 3. The outlet tube 3 in turn features an outflow section 3.2 of length La, through which the exhaust gas flows in from the inside of the housing 4 into the outlet tube 3 in the radial direction to the A-tube axis, and from there leaves the mix box 1 via the outlet 3.8 in the axial direction to the outlet tube 3. Within the housing 4, an intermediate wall 9.2 is provided, which is aligned parallel to the main flow direction H.

Figure 4A:
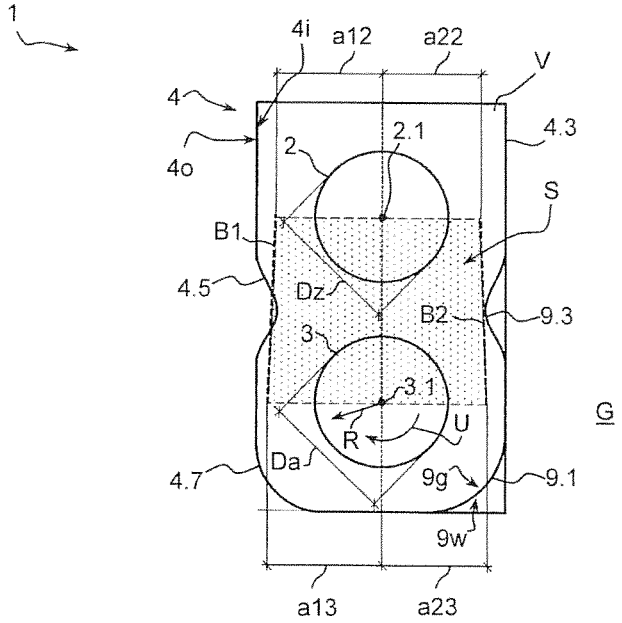
FIG. 4*a* shows a principle sketch of the profile view y-y from FIG. 3.
Figure 4B:
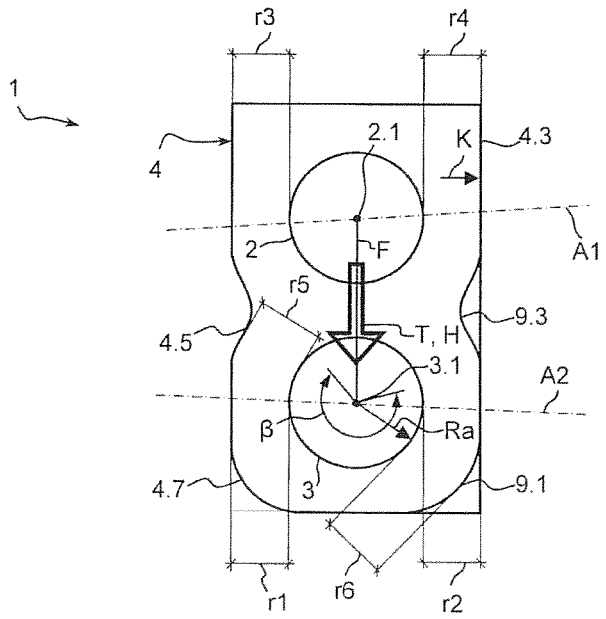
FIG. 4*b* shows a profile view according to FIG. 4*a* with additional parameters.
Figure 7A:
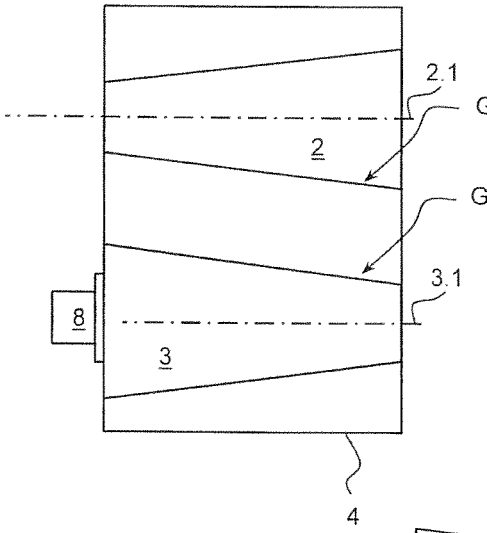
FIGS. 7*a*-8 show the principle sketch of the mix box with truncated cone-shaped tubes.
Figure 7B:
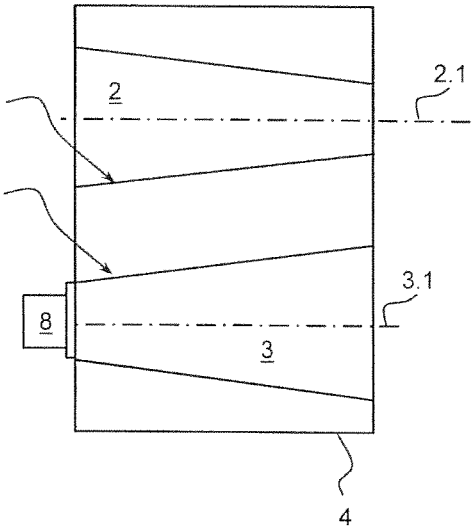

According to FIGS. 4*a*, 4*b*, profile view y-y from FIG. 3, the housing 4 features a housing wall 4.3 with an inner face 4*i* and an outer face 4*o*, which delimits a volume V of the housing in relation to an exhaust gas-free surrounding area. The housing 4 features a basic form with a rectangular profile. In the left half of the image, a recess 4.5 is shown within the housing wall. Additionally, the housing wall 4.3 features a rounded end 4.7 on the lower left edge. The inlet tube 2 or the inflow section 2.2 has a diameter Dz and the outlet tube 3 or the outflow section 3.2 has a diameter Da. The diameter Dz and/or the diameter Da can vary over the respective length Lz, La, as is shown in FIGS. 7*a*, 7*b* for example.

In the right half of the image, two alternatives are shown for the recess 4.5 and the rounded end 4.7. Within the housing 4, two flow guiding elements 9.1, 9.3 are provided, each of which has an inner gas side 9*g* and a wall side 9*w* in the form of separate baffle plates. The baffle plate 9.3 forms a taper similar to the recess 4.5. The baffle plate 9.1 forms a rounded section similar to the rounded end 4.7.

The flow guiding elements 9.1, 9.3 are not a part of the housing wall 4.3, since they do not serve to delimit the volume V in relation to an exhaust-gas free surrounding area G. The wall side 9*w* is after all arranged within the housing 4 and not in the surrounding area.

According to FIG. 4*a*, both the inlet tube 2 and the outlet tube 3 are positioned symmetrically within the housing 4. A flow zone S extends between the two tubes 2, 3, which extends upwards up to the height of the tube axis 2.1 and downwards to the height of the tube axis 3.1. At the side, the flow zone S is delimited by two boundary areas B1, B2, wherein the boundary area B1 is arranged at a distance a12 from the tube axis 2.1 and at a distance a13 from the tube axis 3.1. The boundary area B2 is arranged at a distance a22 from the tube axis 2.1 and at a distance a23 from the tube axis 3.1. The distances a12 and/or a22 can vary over the length Lz. Alternatively or in addition, the distances a13 and/or a23 can vary over the length Lz.

The axial expansion of the flow zone S corresponds to the axial expansion of the inflow section 2.2 or the outflow section 3.2, i.e. the respective length Lz or length La.

The following applies for the respective distance a12, a13, a22, a23: 0<a12<=x1*Dz and 0<a13<=x2*Da, and 0<a22<=x3*Dz, and 0<a23<=x4*Da, wherein the respective value x1, x2, x3, x4 lies at approximately 0.3 according to FIG. 4.

With regard to the boundary area B2 in FIG. 4*a*, the distances a22, a23 are maximized. The boundary area B2 lies at the height of the baffle plate 9.3, which is arranged within the housing 4. While the flow guiding element 9.3 is positioned outside of the flow zone S, the recess 4.5 is arranged as part of the housing wall 4.3 within the flow zone S.

According to FIG. 4*b*, both the distances r1, r2, r3, r4, r5 between the tubes 2, 3 and the housing wall 4.3 or recess 4.5 and as an example also the distance r6 between the tube 3 and the flow guiding element 9.1 are shown. The wall distances r1 to r4 have approximately the same size in relation to an axis A1, A2 arranged at right-angles to the respective tube axis 2.1, 3.1. The sizes of the wall distances r1 to r4 deviate by a maximum of 10% to 30%. In the left half of the image, the inside of the housing 4 is free of flow guiding elements, which would influence the direct inflow of the outlet tube 3 from the inlet tube 2. At most, the recess 4.5 of the housing wall or the rounded end 4.7 has an influence. These should be produced in a simple manner as a part of the housing wall. The distance r5 lies between the outlet tube 3 and the recess 4.5.

In the right half of the image, the two flow guiding elements 9.1, 9.3 are shown in the form of separate baffle plates. They may have a similar effect on the flow, but are separate construction parts which must be mounted separately. The distance r6 is drawn in for the distance between the tube 3 and the flow guiding elements 9.1, 9.3.

The radius Ra of the outlet tube 3 is approximately 20% larger than the wall distance r1 to r5, or larger than the distance r6 from the flow guiding element 9.1.

To enable the symmetrical arrangement of the outlet tube 3 to be improved within the housing 4, the housing 4 features a recess 4.5 in the left half of the image and a rounded end 4.7. These guarantee that the radial distance r5 between the outlet tube 3 and the housing wall 4.3 is almost identical to the angle range β of approximately 140°. In addition to this, baffle plates 9.3, 9.1 are provided according to FIG. 4*b*, which in turn delimit the distance to the outlet tube 3 to the corresponding size r6, so that the angle range β via which the outlet tube 3 features approximately the same distance to the next housing wall 4.3 or to the next flow guiding element 9.1 increases according to FIG. 4*b* to almost 280°. Only the portion of the outlet tube that is directed upwards and towards the inlet tube 2 features a considerably larger distance to the remaining housing wall 4.3. This area is in turn arranged vis-à-vis to the inlet tube 2, so that a current filament F, which moves along a flow vector T, can flow uninterrupted from the inlet tube 2 to the outlet tube 3. The flow vector T in turn connects the two tube axes 2.1, 3.1. Additionally, other current filaments are possible, via which the exhaust gas flow can flow starting from the inlet tube 2 without further deflection to the outlet tube 3.

To guarantee the required distances, corresponding recesses 4.5 and/or rounded ends 4.7 of the housing wall 4.3 or corresponding flow guiding elements 9.3, 9.1 can be provided. While flow guiding elements 9.3, 9.1 are not permitted within the flow zone S according to the definition of the flow zone S, this does not apply to the housing wall 4.3 or parts of said wall.

Figure 4C:
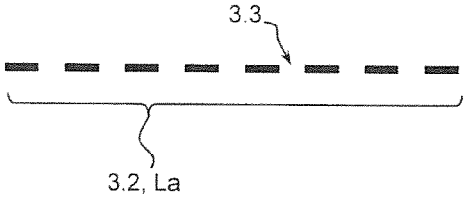
FIG. 4*c* shows a principle sketch relating to the length La.

FIG. 4*c* shows a principle drawing of the length La of the outflow section 3.2, wherein the outflow openings 3.3, which are present as mixing rows or mixing stages, are arranged distributed over which the entire length La.

Figure 4D:
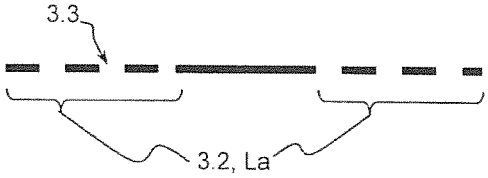
FIG. 4*d* shows a further principle sketch relating to the length La.

According to FIG. 4*d*, the outflow section 3.2 has two parts. Two segments of outflow openings 3.3 or mixing rows or mixing stages are provided, which respectively form a portion of the outflow section 3.2. The length La is accordingly the sum of the lengths of both segments.

Figure 4E:
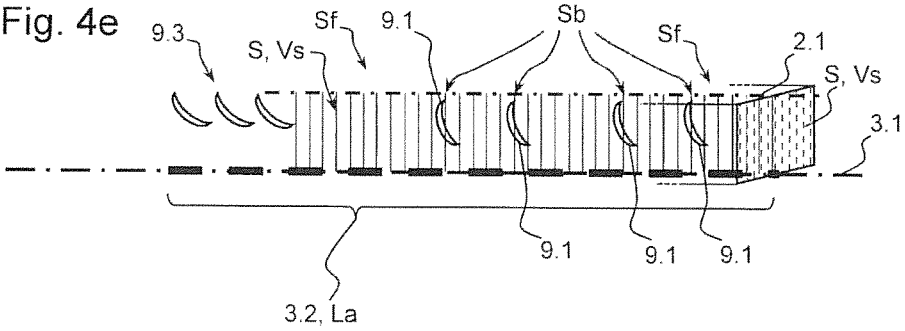
FIG. 4*e* shows a principle sketch relating to the portion Sf and Sa of the flow zones S.

In FIG. 4*e*, different flow zones S are shown within the length La on the one hand and different flow guiding elements 9.3, 9.1 on the other. Over around 77% of the length La, a flow volume Vs can be formed which is defined by the flow zones S. The flow volume Vs is only partially shown in a stylized manner on the right-hand side starting with the first flow zones S. The front part of the outflow section 3.2 is blocked by flow guiding elements 9.3, so that in this area, no flow zone S, or at least no flow volume Vs, can be formed. Within this flow volume, a portion Sf of the flow zones S is free, while a remaining part Sb is blocked by flow guiding elements 9.1.

Figure 5:
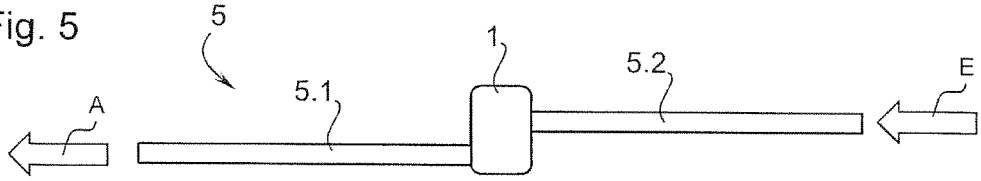
FIG. 5 shows a principle sketch of an exhaust gas system.

FIG. 5 shows the principle sketch of an exhaust system 5 with the mix box 1 and the exhaust gas tubes 5.1, 5.2 connected to it, via which the exhaust system is connected to the motor vehicle or an exhaust gas muffler.

Figure 6:
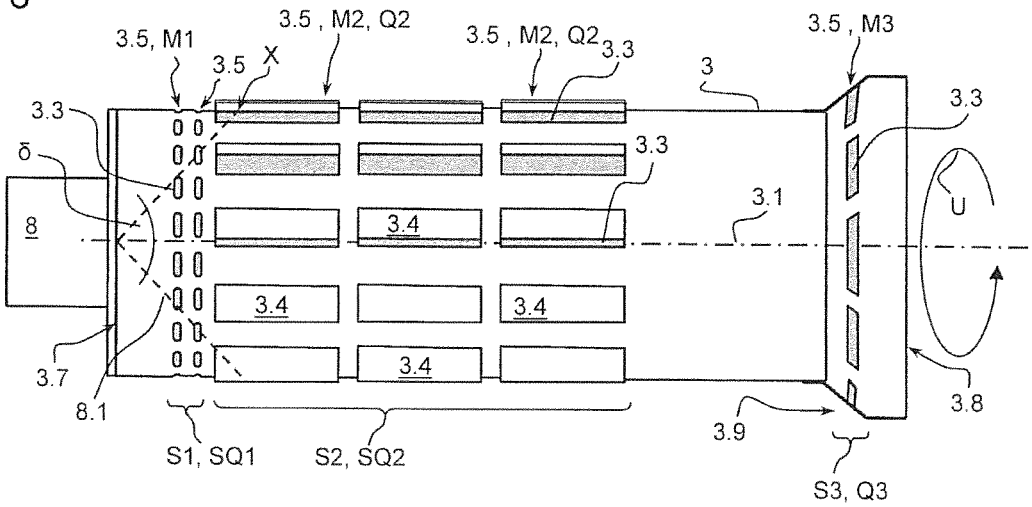
FIG. 6 shows the principle sketch of an outlet tube from the side.

According to FIG. 6, the outlet tube 3 features several rows 3.5 of openings 3.3, an injection nozzle 8 on the inlet 3.7 and an open end on the outlet 3.8. Additionally, a first sector S1 is provided with two rows 3.5 of openings 3.3 with an average opening profile Q, i.e. two stages M1 of the first order are provided. The openings 3.3 are respectively formed as a blade-free recess of the housing wall 4.3. The sum of all opening profiles Q1 of a sector S1 is SQ1. The sum of all opening profiles Q of all openings 3.3 of all rows 3.5 of the outlet tube 3 is SQ. For the ratio between SQ1 and SQ, SQ1<=0.15*SQ initially applies.

Additionally, in the outlet tube 3, a second sector S2 is formed with several stages M2 of several rows 3.5 of openings 3.3 with an average opening profile Q2. The sum of all opening profiles Q2 of the sector S2 is SQ2. The openings 3.3 are formed as a molding on the housing wall 4.3, wherein the molded part of the housing wall 4.3 forms a blade 3.4.

Additionally, a third sector S3 is provided with a row 3.5 of openings 3.3 with an average opening profile Q3. The latter is connected to a conical expansion or a cone 3.9 of the outlet tube 3 on the tube end or the outlet 3.8, so that an enlarged diameter is achieved. All openings 3.3 extend in the circumferential direction U.

The injection nozzle 8 features a spraying cone 8.1, which nominally (without taking a flow into account) has an opening angle δ of approximately 80°. The spraying cone 8.1 cuts the outlet tube 3 at the intersection point X which is arranged within the sector S2.

Figure 8:
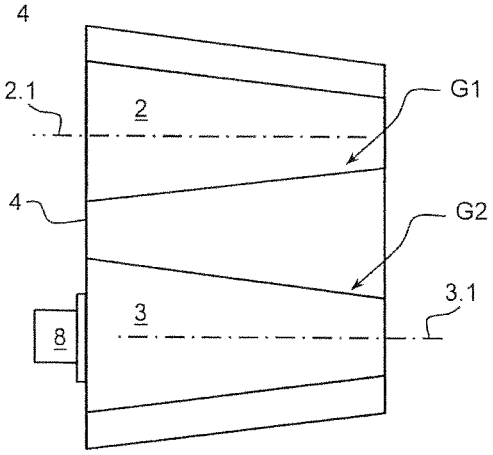

According to the exemplary embodiments shown in FIGS. 7*a*, 7*b* and 8, both the inlet tube 2 and the outlet tube 3 are designed in their basic form G1, G2 as a truncated cone. According to FIGS. 7*a*, 7*b*, both tubes 2, 3 are arranged along the tube axis 2.1, 3.1 in counter directions in relation to the alignment, while according to the exemplary embodiment shown in FIG. 8, both tubes 2, 3 are arranged in the same directions. In this case, the housing 4 also has a truncated cone-shaped basic form, at least in profile, which can be used in corresponding construction space conditions. The formation of a corresponding basic form or the use of corresponding flow guiding elements is necessary in order to guarantee the above distances a12 to a23 or distances r1 to r6, i.e. symmetrical flow conditions.

Figure 9A:
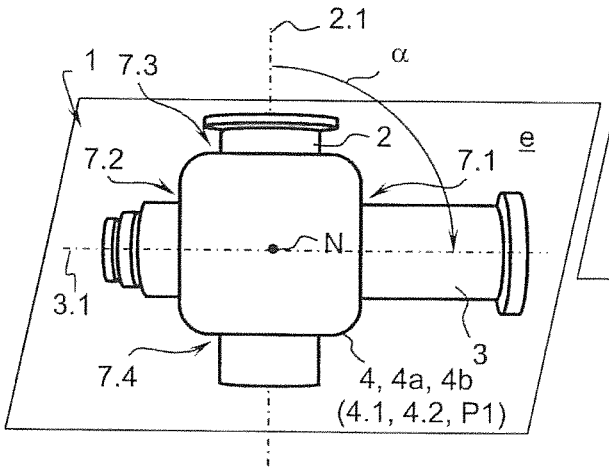
FIGS. 9*a*, 9*b* show the mix box from above.
Figure 9B:
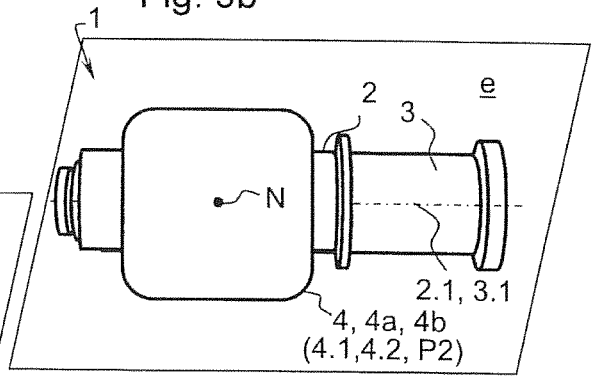

According to the exemplary embodiments shown in FIGS. 9*a*, 9*b*, the housing edge 4*a*, 4*b* not further shown is square, i.e. Is point symmetric in relation to a measurement standard N of the partition plane e, so that the two housing sections 4.1, 4.2 can be pivoted by 90°. According to the exemplary embodiments, the pivot is conducted 90° to the right. Further pivoting options by 180° or 270° or −90° accordingly are naturally also possible. Both tubes 2, 3 are supported in one pair each of passages 7.1 to 7.4.

According to FIG. 9*a*, the first housing half or the first housing section 4.1 and the second housing half or second housing section 4.2 are located in the relative position P1. In the embodiment shown in FIG. 9*b*, both housing shells 4.1, 4.2 are located in the relative position P2 rotated by 90° in relation to each other. This results in a pivot of the inlet and outlet tubes 2, 3 around an angle α of 90°.

Figure 9C:
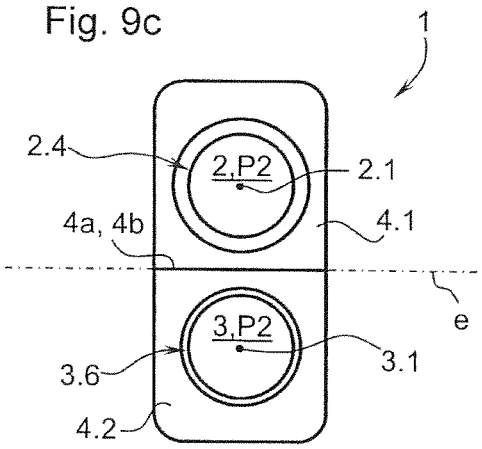
FIG. 9*c* shows the mix box according to FIG. 9*b* from the side.

FIG. 9*c* shows the side view of FIG. 9*b* with the partition plane e and the connected housing edges 4*a*, 4*b*. The inlet tube 2 and the outlet tube 3 are positioned in the respective bearing position 2.4, 3.6, which is formed as a passage. The two tube axes 2.1, 3.1 are aligned in parallel. The tubes 2, 3 are both located in the relative position P2 in relation to the respective housing half 4.1, 4.2.

Figure 10A:
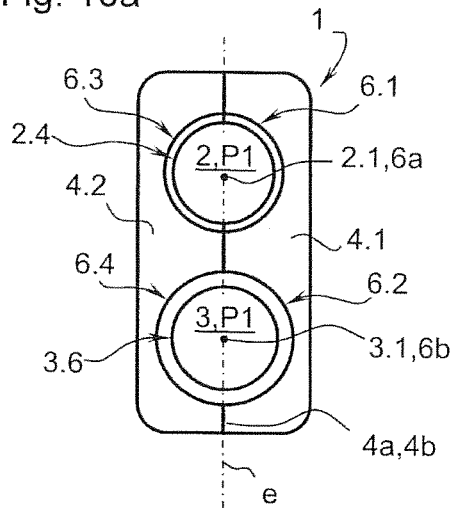
FIGS. 10*a*, 10*b* show the mix box from the side with a modified housing division.
Figure 10B:
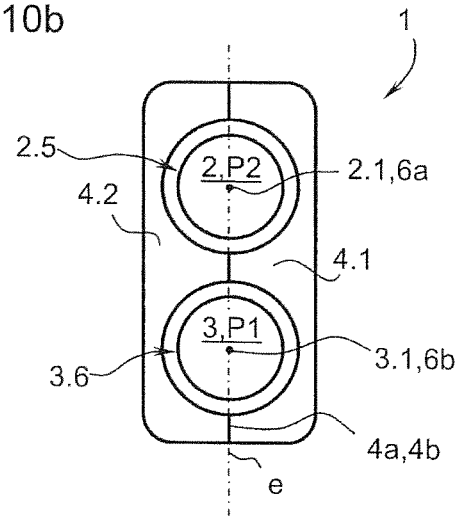

The mix box 1 shown in FIGS. 10*a*, 10*b* features a housing 4 with two housing sections 4.1, 4.2 formed as a housing shell, in which four moldings 6.1, 6.2, 6.3, 6.4 (only two are shown) are provided, wherein in the moldings 6.1, 6.3, an inlet tube 2 is arranged in a position P1 and in the moldings 6.2, 6.4 an outlet tube 3 is also arranged in the position P1. The respective tube 2, 3 features bearing positions 2.4, 2.5, 3.6, via which it is supported in the respective molding.

The respective housing edge 4*a*, 4*b* is aligned parallel to the tube axis 2.1, 3.1. Where the housing edges 4*a*, 4*b* can be brought into contact with each other, they form the partition plane e for the housing 4. Both the inlet tube 2 and the outlet tube 3 feature a tube axis 2.1, 3.1, which is aligned coaxially to a middle axis 6*a*, 6*b* of the respective molding pair 6.1, 6.3 and 6.2, 6.4.

According to the exemplary embodiment shown in FIG. 10*b*, the inlet tube 2 is turned by 180° in contrast to the embodiment shown in FIG. 10*a*. The inlet tube 2 is located in a position P2, while the outlet tube 3 remains in position P1. The inlet tube 2 has an equal diameter D in the area of its bearing positions 2.4, 2.5, i.e. in the area of the respective molding 6.1, 6.3, so that said tube can be easily turned by 180°. The two housing sections 4.1, 4.2 remain in the same relative position P1 to each other. The same can also be applied to the outlet tube 3.

LIST OF REFERENCE NUMERALS

1 Mix Box
2 Inlet tube

2.1 E-tube axis
2.2 Inflow section
2.3 Inflow opening
2.4 Bearing position
2.5 Bearing position
3 Outlet tube
3.1 A-tube axis
3.2 Outflow section
3.3 Outflow opening
3.4 Blade, flap
3.5 Row of 3.3
3.6 Bearing position
3.7 Inlet of 3
3.8 Outlet of 3
3.9 Cone
4 Housing
4*a* Housing edge
4*b* Housing edge
4*i* Inner face
4*o* Outer face
4.1 Housing half, housing section
4.2 Housing half, housing section
4.3 Housing wall
4.4 Connecting flange
4.5 Portion of the housing wall, recess
4.7 Portion of the housing wall, rounded end
Exhaust system
5.1 Exhaust gas tube
5.2 Exhaust gas tube
6.1 Molding
6.2 Molding
6.3 Molding
6.4 Molding
6*a* Middle axis 6.1, 6.3
6*b* Middle axis 6.2, 6.4
7.1 Passage
7.2 Passage
7.3 Passage
7.4 Passage
8 Injection nozzle, feed facility for an additive, dosing device
8.1 Spraying cone
9.1 Baffle plate, flow guiding element
9.2 Intermediate wall
9.3 Baffle plate, flow guiding element
9*g* Gas side
9*w* Wall side
10 Swirl mixer
α Angle
β Angle
δ Spraying angle
A Mix box outlet
A1 Axis
A2 Axis
a12 Distance from B1 to 2.1
a22 Distance from B2 to 2.1
a13 Distance from B1 to 3.1
a23 Distance from B2 to 3.1
B1 Boundary area
B2 Boundary area
D Diameter
Dz Diameter of 2.2
Da Diameter of 3.2
E Mix box inlet
e Partition plane
F Current filament
G Surrounding area
G1 Basic form of 2
G2 Basic form of 3
H Main flow direction
K Curve radius
La Length of 3.2
Lz Length of 2.2
M Stage
M1 Stage
M2 Stage
M3 Stage
N Measurement standard
P1 Position
P2 Position
Q Average opening profile
Q1 Opening profile
Q2 Opening profile
Q3 Opening profile
R Radial direction of the A-tube axis
Ra Radius of 3.2
r1 Radial distance of 3.1
r2 Radial distance 3.1
r3 Radial distance of 2.1
r4 Radial distance 2.1
r5 Radial distance 3.1
r6 Radial distance
S Flow zone
Sf Portion of flow zones=free
Sb Portion of flow zones=blocked
S1 Sector
S2 Sector
S3 Sector
SQ Sum of all Q
SQ1 Sum of S1
SQ2 Sum of S2
T Flow vector
U Circumference, circumferential direction to the A-tube axis
V Volume
Vs Flow volume
V23 Volume
X Intersection point
Z Cylinder radius

What is claimed is:

1. A mix box for an exhaust system of an internal combustion engine for incorporating additives into an exhaust gas flow, comprising:

at least one inlet tube having a closed end and featuring an E-tube axis, at least one outlet tube featuring an A-tube axis, and a housing including a housing wall with an inner face and an outer face for holding the at least one inlet tube and the at least one outlet tube, wherein the housing delimits a volume V of the mix box in relation to the surroundings, wherein the at least one inlet tube includes an inflow section arranged within the housing with a diameter Dz and a length Lz, which is equipped with at least one inflow opening for introducing the exhaust gas into the housing, wherein the at least one outlet tube includes a dosing device on an end side and an outflow section arranged within the housing with a diameter Da and a length La, which, for the purpose of discharging the exhaust gas from the housing, is equipped with at least one outflow opening, wherein a flow zone S is provided between the at least one inlet tube and the at least one outlet tube, which is delimited by a first wall which is a distance a12 from the E-tube axis of the at least one inlet tube and a distance a13 from the A-tube axis of the at least one outlet tube, the flow zone S is further delimited by a second wall which is a distance a22 from the E-tube axis of the at least one inlet tube and a distance a23 from the A-tube axis of the at least one outlet tube, wherein over at least 30% to 50% of the length La, at least one portion Sf=70%, or 80%, or 90% of the flow zone S is free of flow guiding elements, wherein a flow guiding element causes a deflection of the exhaust gas flow into a direction R radial to the A-tube axis and the flow guiding element features a wall side and a gas side which are both arranged within the volume V.

2. The mix box according to claim 1, wherein the following applies for the respective distance a12, a13, a22, a23: 0<a12<=x1*Dz, and 0<a13<=x2*Da, and 0<a22<=x3*Dz, and 0<a23<=x4*Da, wherein the respective value x1, x2, x3, x4 is an element of the number group (3; 2.5; 2; 1.5; 1; ½; ¼), wherein the respective distances a12, a13, a22, a23 can differ in size and/or vary over the respective length Lz, La.

3. The mix box according to claim 1, wherein the outflow section can be flowed around on its outer side by 360°.

4. The mix box according to claim 1, wherein the following applies to the diameter Da: 0.8*Dz<=Da<=1.5*Dz.

5. The mix box according to claim 1, wherein the dosing device is arranged coaxially to the at least one outlet tube, wherein the dosing device has a spraying angle δ, with 5°<=δ<=80°, or 10°<=δ<=60°.

6. The mix box according to claim 1, wherein the at least one outlet tube penetrates the housing wall at two opposite positions.

7. The mix box according to claim 1, wherein the at least one outlet tube includes a blade which is hinged on at least one side in the area of the at least one outflow opening, which protrude inwards or outwards in the radial direction.

8. The mix box according to claim 1, wherein in the at least one inlet tube a degree of perforation decreases in the direction of flow.

9. The mix box according to claim 1, wherein an intermediate wall is provided which is aligned parallel to a main direction of flow H and which does not effect a flow deflection in the circumferential direction.

10. The mix box according to claim 1, wherein the at least one inlet tube has a truncated cone-shaped basic form G1 and/or that the at least one outlet tube has a truncated cone-shaped basic form G2, wherein the at least one inlet tube and the at least one outlet tube can be aligned in relation to the basic form G1, G2 in the same direction or in the counter direction.

11. The mix box according to claim 1, wherein the housing is formed from at least two to three housing sections, which can be formed with single or double walls, and at least one connecting flange for each of the housing sections.

12. The mix box according to claim 1, wherein the at least one outlet tube includes several rows of the at least one outflow opening arranged over a circumference U, through which the exhaust gas can flow into the interior of the at least one outlet tube, wherein the at least one outflow opening of one row respectively forms a step M and wherein the respective step M is characterized according to its size by the average opening profile Q of the outflow openings, wherein the sum of all opening profiles Q of all outflow openings of all rows of the at least one outlet tube equals SQ, wherein at least one step of a first order, step M1, is provided, wherein step M1 includes outflow openings with an average opening profile Q1, and when additionally at least one step of a second order, step M2, is provided, wherein step M2 includes outflow openings with an average opening profile Q2 with Q2>=f*Q1, with 5<=f<=25, and when a first sector S1 is provided, which is designed as a rinsing sector, which is formed from at least the one step M1, and when a second sector S2 is provided which is formed as a mixing sector, and which is formed from at least the one step M2, wherein in the direction of flow the first sector S1 is positioned, followed by the second sector S2.

13. The mix box according to claim 12, wherein the sector S1 has a sum SQ1 of the opening profiles Q1 with SQ1<=x1*SQ, with 0.05<x1<=0.25 and/or the sector S1 is formed from a maximum of three to five stages M1.

14. The mix box according to claim 12, wherein a spraying cone is provided with a spraying angle δ, wherein the spraying angle δ is selected in such a manner that an intersection point X is provided between the spraying cone and the at least one outlet tube in the flow direction after the first sector S1 and/or within the second sector S2.

15. The mix box according to claim 1, wherein the housing includes a first housing section with a first housing edge and at least one second housing section with a second housing edge, wherein the first housing section and the at least one second housing section are connected at least partially via the housing edge, and when the at least one inlet tube includes an inflow section arranged within the housing, which is equipped with at least one inflow opening for introducing the exhaust gas into the housing, wherein a) the respective housing edge includes at least two moldings, each with a middle axis, and/or b) the respective housing section includes at least two passages each with one middle axis and the respective tube includes support points, via which it is supported within the moldings or within the passages, wherein i) the respective tube is symmetrically formed in relation to the formation of the support points and for the purpose of mounting can be supported in at least two different positions R1, R2 in the respective molding, or i) the at least one inlet tube and the at least one outlet tube are designed in the same way with regard to the formation of the support points.

16. A mix box for an exhaust system of an internal combustion engine for incorporating additives into an exhaust gas flow, comprising:

at least one inlet tube having a closed end and featuring an E-tube axis, at least one outlet tube including an A-tube axis and a housing including a housing wall with an inner face and an outer face for holding the at least one inlet tube and the at least one outlet tube, wherein the housing delimits a volume V of the mix box in relation to the surroundings, wherein the at least one inlet tube includes an inflow section arranged within the housing with a diameter Dz and a length Lz, which is equipped with at least one inflow opening for introducing the exhaust gas into the housing, wherein the at least one outlet tube includes a dosing device on an end side and an outflow section arranged within the housing with a diameter Da and a length La, which for the purpose of discharging the exhaust gas from the housing is equipped with at least one outflow opening, wherein a) the at least one outlet tube includes a tube radius Ra=Da/2 and radial distances r1, r2, r5, r6 to the inner face of the housing wall and/or to a flow guiding element, wherein a1) the distances r1, r2 on a respective axis A2 are arranged at right-angles to the A-tube axis and deviate from each other by a maximum of 10% to 30%, or a2) with regard to an angle range β of at least 90° to 270° or of at least 160° to 200° around the A-tube axis, a2i) the distance r6 to the flow guiding element and the distance r5 to the housing wall deviate from each other by a maximum of 10% to 30% and/or a2ii) a ratio of the tube radius Ra to at least one of the distances r1, r5, and r6 is a maximum of 6 or a maximum of 3, or b) the inflow section and the outflow section delimit a volume V23 and a differential volume V1=V−V23 fulfils the following condition: V1=1.2*V23.

17. The mix box according to claim 16, outflow section can be flowed around on its outer side by 360°, wherein the following applies to the diameter Da: 0.8*Dz<=Da<=1.5*Dz, wherein the dosing device is arranged coaxially to the at least one outlet tube, and wherein the dosing device features a spraying angle δ, with 5°<=δ<=80°, or 10°<=δ<=60°.

18. The mix box according to claim 16, wherein the at least one outlet tube penetrates the housing wall at two opposite positions, wherein the at least one outlet tube features a blade which is hinged on at least one side in the area of the at least one outflow opening, which protrude inwards or outwards in the radial direction, and wherein in the at least one inlet tube a degree of perforation decreases in the direction of flow.

19. The mix box according to claim 16, wherein an intermediate wall is provided which is aligned parallel to a main direction of flow H and which does not effect a flow deflection in the circumferential direction, wherein the at least one inlet tube has a truncated cone-shaped basic form G1 and/or that the at least one outlet tube has a truncated cone-shaped basic form G2, wherein the at least one inlet tube and the at least one outlet tube can be aligned in relation to the basic form G1, G2 in the same direction or in the counter direction, and wherein the housing is formed from at least two to at least three housing sections, which can be formed with single or double walls, and at least one connecting flange for each housing sections.

20. The mix box according to claim 16, wherein the at least one outlet tube including several rows of outflow openings arranged over a circumference U, through which the exhaust gas can flow into the interior of the at least one outlet tube, wherein the at least one outflow opening of one row respectively forms a step M and wherein the respective step M is characterized according to its size by the average opening profile Q of the openings, wherein the sum of all opening profiles Q of all outflow openings of all rows of the at least one outlet tube equals SQ, wherein at least one step of a first order, step M1, is provided, wherein step M1 includes outflow openings with an average opening profile Q1, and when additionally at least one step of a second order, step M2, is provided, wherein step M2 includes outflow openings with an average opening profile Q2 with Q2>=f*Q1, with 5<=f<=25, and when a first sector S1 is provided, which is designed as a rinsing sector, which is formed from at least the one step M1, and when a second sector S2 is provided which is formed as a mixing sector, and which is formed from at least the one step M2, wherein in the direction of flow the first sector S1 is positioned, followed by the second sector S2, wherein the sector S1 features a sum SQ1 of the opening profiles Q1 with SQ1<=x1*SQ, with 0.05<x1<=0.25 and/or the sector S1 is formed from a maximum of three to five stages M1, wherein a spraying cone is provided with a spraying angle δ, wherein the spraying angle δ is selected in such a manner that an intersection point X is provided between the spraying cone and the outlet tube in the flow direction after the first sector S1 and/or within the second sector S2, and wherein the housing features a first housing section with a first housing edge and at least one second housing section with a second housing edge, wherein the first housing section and the at least one second housing section are connected at least partially via the housing edge, and when the at least one inlet tube features an inflow section arranged within the housing, which is equipped with at least one inflow opening for introducing the exhaust gas into the housing, wherein c) the respective housing edge including at least two moldings, each with a middle axis, and/or d) the respective housing section includes at least two passages each with one middle axis and the respective tube includes bearing positions, via which it is supported within the moldings or within the passages, wherein iii) the respective tube is symmetrically formed in relation to the formation of the bearing positions and for the purpose of mounting can be supported in at least two different positions R1, R2 in the respective molding, or the at least one inlet tube and the outlet tube are designed in the same way with regard to the formation of the bearing positions.

21. A mix box for an exhaust system of an internal combustion engine for incorporating additives into an exhaust gas flow, comprising:

at least one inlet tube having a closed end and featuring an E-tube axis, at least one outlet tube featuring an A-tube axis, and a housing including a housing wall with an inner face and an outer face for holding the at least one inlet tube and the at least one outlet tube, wherein the housing delimits a volume V of the mix box in relation to the surroundings, wherein the at least one inlet tube includes an inflow section arranged within the housing with a diameter Dz and a length Lz, which is equipped with at least one inflow opening for introducing the exhaust gas into the housing, wherein the at least one outlet tube includes a dosing device on an end side and an outflow section arranged within the housing with a diameter Da and a length La, which, for the purpose of discharging the exhaust gas from the housing, is equipped with at least one outflow opening, wherein a flow zone S is provided between the at least one inlet tube and the at least one outlet tube, which is delimited by a first wall which is a distance a12 from the E-tube axis of the at least one inlet tube and a distance a13 from the A-tube axis of the at least one outlet tube, the flow zone S is further delimited by a second wall which is a distance a22 from the E-tube axis of the at least one inlet tube and a distance a23 from the A-tube axis of the at least one outlet tube, wherein over at least 30% to 50% of the length La, at least one portion Sf=70%, or 80%, or 90% of the flow zone S is free of flow guiding elements, wherein a flow guiding element causes a deflection of the exhaust gas flow into a direction R radial to the A-tube axis and the flow guiding element features a wall side and a gas side which are both arranged within the volume V, wherein the flow guide elements are positioned adjacent to the outflow section in respect to a radial direction of the A-tube axis.

* * * * *